US006025063A

United States Patent [19]

Nakao et al.

[11] Patent Number: 6,025,063

[45] **Date of Patent: *Feb. 15, 2000**

[54] FABRIC FOR INK JET RECORDING

[75] Inventors: Takuya Nakao; Isamu Takeshita, both of Yokohama, Japan

[73] Assignee: Asahi Glass Company Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/651,058

[22] Filed: May 21, 1996

[30] Foreign Application Priority Data

May 22, 1995 [JP] Japan ..... 7-122660

[51] Int. Cl.[7] ..... B41M 5/00; B41J 2/01

[52] U.S. Cl. ..... 428/304.4; 428/195; 428/328; 428/329; 428/480; 428/520; 442/181; 442/304

[58] Field of Search ..... 428/195, 520, 428/480, 328, 329, 304.4; 442/181, 304

[56] References Cited

U.S. PATENT DOCUMENTS 5,605,750 2/1997 Romano et al. ..... 428/195

FOREIGN PATENT DOCUMENTS

| | | |
|---|---|---|
| 0 631 006 | 12/1994 | European Pat. Off. . |
| 0 704 315 | 4/1996 | European Pat. Off. . |
| 0 709 520 | 5/1996 | European Pat. Off. . |
| 7-238467 | 9/1995 | Japan . |
| 8-90900 | 4/1996 | Japan . |

OTHER PUBLICATIONS

Database WPI Section Ch, Week 9328 Derwent Publications Ltd., London, GB; Class A87, AN 93–224709 XP002056148 & JP 05 148 776 A (Kanebo Ltd), Jun. 15, 1993 Abstract.

Database WPI Section Ch, Week 9431 Derwent Publications Ltd., London, GB; Class F06, An 94–253440 XP002056149 & JP 06 184 954 A (Asahi Glass Co Ltd), Jul. 5, 1994 Abstract.

Database WPI Sectionn Ch, Week 9245 Derwent Publications Ltd., London, GB; Class A11, AN 92–369587 XP002056150 & JP 04 270 679 A (Komatsu Seiren KK), Sep. 28, 1992 Abstract.

*Primary Examiner*—Pamela R. Schwartz

*Attorney, Agent, or Firm*—Oblon, Spivak, McClelland, Maier & Neustadt, P.C.

[57] ABSTRACT

A fabric for ink jet recording, which has a boehmite porous layer on the fiber surface of the fabric and is softening-treated.

3 Claims, No Drawings

FABRIC FOR INK JET RECORDING

The present invention relates to a fabric for ink jet recording, particularly a fabric capable of forming an image of high quality by ink jet recording system, and also relates to a method for preparing the same.

It is known in the ink jet recording on a fabric to provide an porous inorganic material on the surface of the fabric in order to obtain a clear image by preventing an ink blot. When the porous inorganic material is provided on the fabric by bonding them with a binder, the fibers of the fabric are bonded to each other, thereby providing a very hard feeling.

An object of the present invention is to provide an ink jet recording medium comprising a fabric substrate having a soft feeling, on which a precise and clear printing can be made.

The present invention provides a fabric for ink jet recording, which has a porous boehmite layer on the fiber surface of the fabric and is softening-treated.

Examples of the softening treatment of a fabric include stretching treatment, calendering treatment or the like, and means a treatment of moving contact parts of fibers. The softening treatment provides a soft feeling by untying adhesion between fibers even when the porous boehmite layer is formed on the fiber surface of the fabric. Also, the calendering treatment improves smoothness of the fabric and also improves image quality and color density.

It is particularly preferable to employ a knit having less fiber contact points as a fabric substrate since it provides a higher effect. The material of the fibers of a fabric used is not specially limited, and various natural fibers and synthetic fibers can be employed.

As a fabric substrate, a knit comprising a cation dyeable polyester is particularly preferable since the adsorptivity of boehmite on this knit is satisfactory and a porous boehmite layer can be uniformly formed on the fiber, thereby providing a clear printed image without causing an ink blot as compared with other usual polyesters.

When a fabric having large openings and poor size stability such as a knit, is printed by means of ink jet printing system, there are problems of getting ink passed through the fabric to the opposite side and making deformed printed images. In order to solve these problems, a releasable paper or film may be attached to the fabric substrate to make the ink jet printing easy. The paper or film thus attached is released after printing.

The paper or film thus attached is not specially limited and various materials can be employed so long as it has such a strength as to stabilize the size of the fabric. The thickness of the paper or film is preferably from 20 to 200 $\mu$m. If the paper or film is too thick, it causes abrasion with an ink head, and on the other hand, if the paper or film is too thin, a satisfactory strength can not be provided and it is often broken.

The attachment of a paper or film on a fabric by an adhesive agent is preferably conducted after previously coating or spraying the adhesive agent on the paper or film so that the attachment does not influence unfavorably on the fabric. The adhesive agent may be any of aqueous type and solvent type materials, examples of which include a polyvinyl acetate, an acryl-modified resin, an ethylene-vinyl acetate copolymer, a SBR latex, a polyvinyl alcohol, a starch and the like.

A boehmite porous layer has functions of receiving a jetted ink, fixing its coloring matter and developing color as an image. The porous boehmite layer is formed on the fabric substrate by being attached to the fiber surface. Boehmite is a crystal expressed by the compositional formula, $Al_2O_3.nH_2O$ (n=1–1.5), and its surface is cationic, and strongly and uniformly adsorbs dyes in the ink with a satisfactory dispersibility. Also, the secondary aggregate diameter of boehmite is preferably controlled so as to be from 50 to 200 nm, thereby reducing scattering of light, and color development of dyes becomes satisfactory in respect of density and chroma and provides clear images without cloud.

The porous boehmite layer is preferably in such a state as that boehmite particles are bonded by a binder. Examples of the binder include starch or its modified product, polyvinyl alcohol or its modified product, SBR latex, NBR latex, carboxymethyl cellulose, hydroxymethyl cellulose, polyvinylpyrrolidone or other organic materials. The binder is used preferably in an amount from 5 to 50 wt % on the basis of the weight of boehmite. If the amount of the binder is less than 5 wt %, the strength of the boehmite layer becomes insufficient, and on the other hand, if the amount of the binder exceeds 50 wt %, the ink absorptivity and the colorant-adsorbing property tend to be inadequate, such being undesirable.

The coated amount of the porous boehmite layer is preferably within the range of from 2 to 60 g/m$^2$. If the coated amount is less than 2 g/m$^2$, the colorant-fixing property and the ink absorptivity tend to be inadequate, whereby clear and high color density recording can not be obtained. On the other hand, if the coated amount exceeds 60 g/m$^2$, not only the material is consumed excessively, but also the flexibility of the substrate tends to be impaired, such being undesirable. More preferably, the coated amount is from 4 to 30 g/m$^2$.

The means of forming the porous boehmite layer on the surface of the fabric is not specially limited, but it is preferable to employ a method of getting the fabric impregnated with a coating solution comprising a boehmite sol and a binder. Thereafter, the fabric is preferably wrung and then dried.

When a cationic resin layer is formed beneath the boehmite porous layer or when a cationic resin is contained in the porous boehmite layer, the effect of adsorbing a dye can be increased, so that an image having a higher density and higher clarity can be obtained. Further, it is possible to improve the water resistance of the dye.

As the cationic resin, a polyethyleneimine, a polyamide resin, a reaction product of a low molecular weight polyfunctional amine with a compound polyfunctional to amino groups (such as epihalohydrin), an acrylamine copolymer resin (such as a quaternary ammonium salt polymer), a polyamide epichlorohydrin resin, or a modified product thereof, may be employed.

It is possible to improve the water resistance by using a cationic resin having a high molecular weight, such as a polyethyleneimine with a molecular weight of at least 10,000. Further, by crosslinking, the water resistance can be improved. As a means for crosslinking, it is possible to employ a method of adding a thermosetting resin such as a urea resin, a melamine resin, an amide resin or an epoxy resin, to a cationic resin such as a polyamine or a polyethyleneimine, or a method of curing by addition of an electron beam or ultraviolet ray curable resin such as a polyester acrylate, a polyether acrylate, an epoxy acrylate or a urethane acrylate.

The cationic resin layer is preferably formed by getting a fabric impregnated or coated with a dispersion having a resin dispersed in an appropriate solvent. Alternatively, the cationic resin may be previously incorporated into a boehmite coating solution.

Now, the present invention will be described in further detail with reference to Examples. However, it should be understood that the present invention is by no means restricted to such specific Examples.

EXAMPLE 1

A boehmite sol (solid content=18 wt %, dispersed particle diameter of boehmite=150 nm), a polyvinyl alcohol (saponification degree=96.5%, tradename "MA26" manufactured by Shin-Etsu Chemical Co., Ltd.) and a cationic resin solution (cation-modified acrylic resin, solid content=30 wt %, tradename "SPO-600" manufactured by Nihon Junyaku Co., Ltd.) were mixed respectively at a solid content weight ratio of 100:8:10, and water was added to the resultant mixture to prepare a boehmite coating solution having a total solid content of 10 wt %. A cation dyeable polyester knit (140 g/m$^2$) was dipped in the above prepared coating solution, and water was wrung out of the knit at a wringing rate of 80%. The knit thus treated was dried at 140° C. to form a porous boehmite layer on the fiber surface. After drying, the knit was softened by a hand, and was subjected to calender treatment at a line pressure of 3 kgf/cm. Thereafter, a paper having an adhesive agent sprayed thereon, was attached to one side of the above-treated knit.

A black solid printing was then applied on the above prepared knit by an ink jet printer, and the color density of the black solid image was measured by a Macbeth color densitometer RD918 and the color density was measured to be 1.23. Also, in order to evaluate the water resistance, the printed knit was bathed in water at room temperature for 24 hours, but there was no change in the printed color density and any ink blot was not recognized. Further, the knit thus obtained had a pleasant touch and a satisfactory feeling.

EXAMPLE 2

The same boehmite sol and polyvinyl alcohol as used in Example 1 were mixed respectively at a solid content weight ratio of 100:8, and water was added to the resultant mixture to prepare a coating solution having a total solid content of 10 wt %. A porous boehmite layer was formed on the fiber surface of a cation dyeable polyester knit in the same manner as in Example 1, except that the above prepared coating solution was used. The knit thus prepared was softened by a hand and was subjected to calender treatment, and thereafter a paper having an adhesive agent sprayed thereon was attached to the knit. The same evaluation test as conducted in Example 1 was carried out and a color density was 1.23. In the evaluation test of water resistance, there was no change in the printed color density, except that a blot of magenta ink was slightly recognized. Also, the knit thus treated had a pleasant touch and a satisfactory feeling.

EXAMPLE 3

A porous boehmite layer was formed on a cation dyeable polyester knit in the same manner as in Example 1, and after drying, a paper having an adhesive agent sprayed thereon was attached to the knit without softening treatment. The same evaluation test as in Example 1 was carried out, and a color density was measured to be 1.18. In the evaluation test of water resistance, there was no change in the printed color density and an ink blot was not recognized. However, the knit thus obtained did not have a pleasant touch and a satisfactory feeling.

EXAMPLE 4

A porous boehmite layer was formed on the fiber surface of a cation dyeable polyester knit in the same manner as in Example 2, and after drying, a paper having an adhesive agent sprayed thereon was attached to the knit. The same evaluation test as in Example 1 was carried out, and a color density was measured to be 1.18. In the evaluation test of water resistance, there was no change in the printed color density, but a blot of magenta ink was slightly recognized. However, the knit was poor in touch and feeling.

As mentioned above, according to the present invention, it is possible to precisely and clearly print on a fabric substrate without impairing a pleasant feeling of a fabric.

What is claimed is:

1. A softened fabric for ink jet recording, which has a porous boehmite layer on the fiber surface of a fabric, said porous boehmite layer comprised of boehmite particles bonded with a binder, and said fabric, after formation of the porous boehmite layer, softened by a mechanical softening treatment.

2. The fabric for ink jet recording according to claim 1, wherein the binder is a polyvinyl alcohol.

3. The fabric for ink jet recording according to claim 1, wherein the amount of the binder is from 5–50 wt. % on the basis of the weight of boehmite.

* * * * *